US010371131B2

(12) United States Patent
Bae et al.

(10) Patent No.: US 10,371,131 B2
(45) Date of Patent: Aug. 6, 2019

(54) LINEAR COMPRESSOR

(71) Applicant: LG ELECTRONICS INC., Seoul (KR)

(72) Inventors: Sanghyun Bae, Seoul (KR); Wonsik Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 353 days.

(21) Appl. No.: 15/175,383

(22) Filed: Jun. 7, 2016

(65) Prior Publication Data

US 2017/0002801 A1 Jan. 5, 2017

(30) Foreign Application Priority Data

Jul. 1, 2015 (KR) ..... 10-2015-0094064

(51) Int. Cl.

| | |
|---|---|
| ***F04B 3/00*** | (2006.01) |
| ***F04B 19/00*** | (2006.01) |
| ***F04B 35/04*** | (2006.01) |
| ***F04B 39/00*** | (2006.01) |
| ***F04B 39/04*** | (2006.01) |
| ***F04B 39/10*** | (2006.01) |

(52) U.S. Cl.

CPC ..... *F04B 3/003* (2013.01); *F04B 19/003* (2013.01); *F04B 35/045* (2013.01); *F04B 39/0044* (2013.01); *F04B 39/044* (2013.01); *F04B 39/10* (2013.01)

(58) Field of Classification Search

CPC ..... F04B 3/003; F04B 19/003; F04B 35/045; F04B 39/044; F05B 25/005

USPC ..... 417/256–257, 258, 419, 469, 417, 211

See application file for complete search history.

(56) References Cited

U.S. PATENT DOCUMENTS

| | | | | | |
|---|---|---|---|---|---|
| 39,974 | A | * | 9/1863 | Virdin | F04B 3/003 417/258 |
| 254,851 | A | * | 3/1882 | Waring | F04B 3/003 417/258 |
| 905,640 | A | * | 12/1908 | Borchers | F04B 3/003 417/258 |
| 1,433,649 | A | * | 10/1922 | Powell | F02B 25/00 123/47 R |

(Continued)

FOREIGN PATENT DOCUMENTS

| | | |
|---|---|---|
| CN | 103282656 | 9/2013 |
| JP | 2004-353563 | 12/2004 |

(Continued)

OTHER PUBLICATIONS

Chinese Office Action dated Jan. 2, 2019 with English Translation.

*Primary Examiner* — Christopher S Bobish
(74) *Attorney, Agent, or Firm* — Ked & Associates LLP

(57) ABSTRACT

A linear compressor is provided that may include a cylinder, to which a discharge valve may be coupled; a first piston, which may be provided to enable a reciprocating motion in an inside of the cylinder; a second piston, which may be provided to enable a reciprocating motion in an inside of the first piston; a first compression chamber formed between the discharge valve and the first piston; and a second compression chamber formed between the first piston and the second piston. The first piston and second piston may move in opposite directions with respect to each other.

18 Claims, 13 Drawing Sheets

(56) References Cited

U.S. PATENT DOCUMENTS 2,202,175 A * 5/1940 Teeter ..... F25B 31/00 417/255
2,572,977 A * 10/1951 Bodine, Jr. ..... F04B 19/003 417/211
2,645,184 A * 7/1953 Lowe ..... F02M 37/043 137/38
2,779,294 A * 1/1957 Manning ..... F04B 29/00 417/262
3,286,911 A * 11/1966 Clarke ..... F04B 25/005 417/254
3,861,222 A 1/1975 Braun et al.
3,894,405 A * 7/1975 Mielitz ..... F04B 3/003 417/231
4,226,408 A * 10/1980 Tomita ..... B60G 15/12 188/289
4,479,758 A * 10/1984 Hersom ..... A23G 3/0257 222/129.2
4,598,630 A * 7/1986 Kao ..... F04B 3/00 92/129
5,542,827 A * 8/1996 Dombek ..... F02M 37/16 417/486
6,015,270 A 1/2000 Roth
8,070,460 B2 * 12/2011 Lee ..... F04B 39/0261 417/211
8,360,751 B2 * 1/2013 Duncan ..... F04B 5/00 166/108
9,777,717 B2 * 10/2017 Schmidt ..... F04B 25/02
2004/0052651 A1 3/2004 Beetz et al.

FOREIGN PATENT DOCUMENTS

KR 10-0748546 8/2007
KR 10-1454550 B1 10/2014

* cited by examiner

LINEAR COMPRESSOR

CROSS-REFERENCE TO RELATED APPLICATION(S)

This application claims priority under 35 U.S.C. § 119 to Korean Application No. 10-2015-0094064, filed in Korea on Jul. 1, 2015, whose entire disclosure is hereby incorporated by reference.

BACKGROUND

1. Field

A linear compressor is disclosed herein.

2. Background

FIG. 1 shows a configuration of a linear compressor according to the related art. Referring to FIG. 1, a linear compressor 1 according to the related art includes a cylinder 3 provided in an interior of a shell 2, a piston 4 that linearly reciprocates in the interior of the cylinder 3, and a motor assembly 20 that provides a driving force to the piston 4.

The shell 2 includes a suction unit or inlet 2*a*, through which a refrigerant is introduced, and a discharge unit or outlet 2*b*, through which a refrigerant compressed in the interior of the cylinder 3 is discharged. A refrigerant suctioned through the suction unit 2*a* flows into an interior of the piston 4 through a suction muffler 30. As a refrigerant passes through the suction muffler 30, noise may be reduced.

In the inside of the cylinder 3, a compression space P in which a refrigerant is compressed by the piston 4, is formed. A suction hole, through which a refrigerant is introduced into the compression space P, is formed in the piston 4, and a suction valve 5 configured to selectively open the suction hole is provided in or at one side of the suction hole.

A discharge valve assembly for discharging the refrigerant compressed in the compression space P is provided in or at one side of the compression space P. That is, the compression space P may be understood as a space formed between a one end side of the piston 4 and the discharge valve assembly.

A discharge cover 7 configured to form a discharge space of a refrigerant, a discharge valve 6 opened when a pressure of the compression space P is a discharge pressure or more and introducing a refrigerant into the discharge space, and a valve spring 8 provided between the discharge valve 6 and the discharge cover 7, and providing elastic force in an axial direction are included in the discharge valve assembly. The term "axial direction" may be understood as a direction in which the piston 4 reciprocates, that is, a transverse direction in FIG. 1.

A frame 10 is further included in the linear compressor 1. The frame 10 is configured to fix the cylinder 3, configured integrally with the cylinder 3 or may be fastened by a separate fastening member.

Stators 21 and 22 and a permanent magnet 23 are included in the motor assembly 20. An outer stator 21 fixed to the frame 10 and arranged to surround the cylinder 3, and an inner stator 22 spaced apart to or at an inner side of the outer stator 21 are included in the stators 21 and 22. The permanent magnet 23 may be located in a space between the outer stator 21 and the inner stator 22. The permanent magnet 23 may be linearly reciprocated by a mutual electromagnetic force between the outer stator 21 and the inner stator 22.

The permanent magnet 23 may be coupled to the piston 4 by a connection member 24. The connection member 24 may be extended to the permanent magnet 23 from one end of the piston 4. As the permanent magnet 23 is linearly moved, the piston 4 may be linearly reciprocated in the axial direction with the permanent magnet 23.

A coil winding body and a stator core are included in the outer stator 21. A bobbin and a coil wound in a circumferential direction of the bobbin are included in the coil winding body. The stator core is configured so that a plurality of laminations is stacked in the circumferential direction, and may be arranged to surround the coil winding body.

When a current is applied to the motor assembly 20, the current flows in the coil, a flux is formed around the coil by the current flowing in the coil and the flux flows along the outer stator 21 and the inner stator 22 while forming a closed circuit. As the flux flowing along the outer stator 21 and the inner stator 22 and the flux of the permanent magnet 23 are interacting, a force for moving the permanent magnet 23 may be generated.

A stator cover 29 is provided in or at one side of the outer stator 21. One end of the outer stator 21 is supported by the frame 10 and the other end may be supported by the stator cover 29.

The inner stator 22 is fixed to an outer periphery of the cylinder 3. The inner stator 22 is configured so that a plurality of laminations is stacked at an outer side of the cylinder 3 in the circumferential direction.

A supporter 25 that supports the piston 4 and a back cover 26 that extends from the piston 4 toward the suction unit 2*a* are further included in the linear compressor 1. The back cover 26 may be arranged to cover at least a portion of the suction muffler 30.

A plurality of springs 27 and 28 to which an inherent number of vibrations is adjusted, is included in the linear compressor 1, so that the piston 4 may able to perform a resonant motion. A first spring 27 supported between the supporter 25 and the stator cover 29 and a second spring 28 supported between the supporter 25 and the back cover 26 are included in the plurality of springs 27 and 28. A plurality of first springs 27 may be provided at both sides of the cylinder 3 or the piston 4, and a plurality of second springs 28 may be provided at the cylinder 3 or a rear of the piston 4.

With respect to such a related art linear compressor, the present Applicant has filed and registered an application (hereinafter referred to as a "prior application"), Korean Patent Registration No. KR 10-1454550, entitled "linear compressor", which is hereby incorporated by reference. In order to increase a capacity of a compressor, it is necessary to increase a drive frequency of the compressor or a bore of a cylinder. If, in consideration of a size or operation reliability of a compressor, the drive frequency and the bore of the cylinder should be fixed to a specific value, in order to increase the capacity of the compressor, it is necessary to increase a stroke of a piston (or stroke).

However, according to the related art linear compressor, due to interference of a piston and adjacent components, a stator forming a motor, and a limited length of a permanent magnet, there is a problem that there are limitations to increasing the stroke of the piston to a set level or higher. After all, there is a problem that the capacity of a linear compressor cannot be improved.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. However, embodiments are not limited to the embodiments described herein, and those of ordinary skill in the art will be able to easily suggest another embodiment within the scope.

Figure 2:
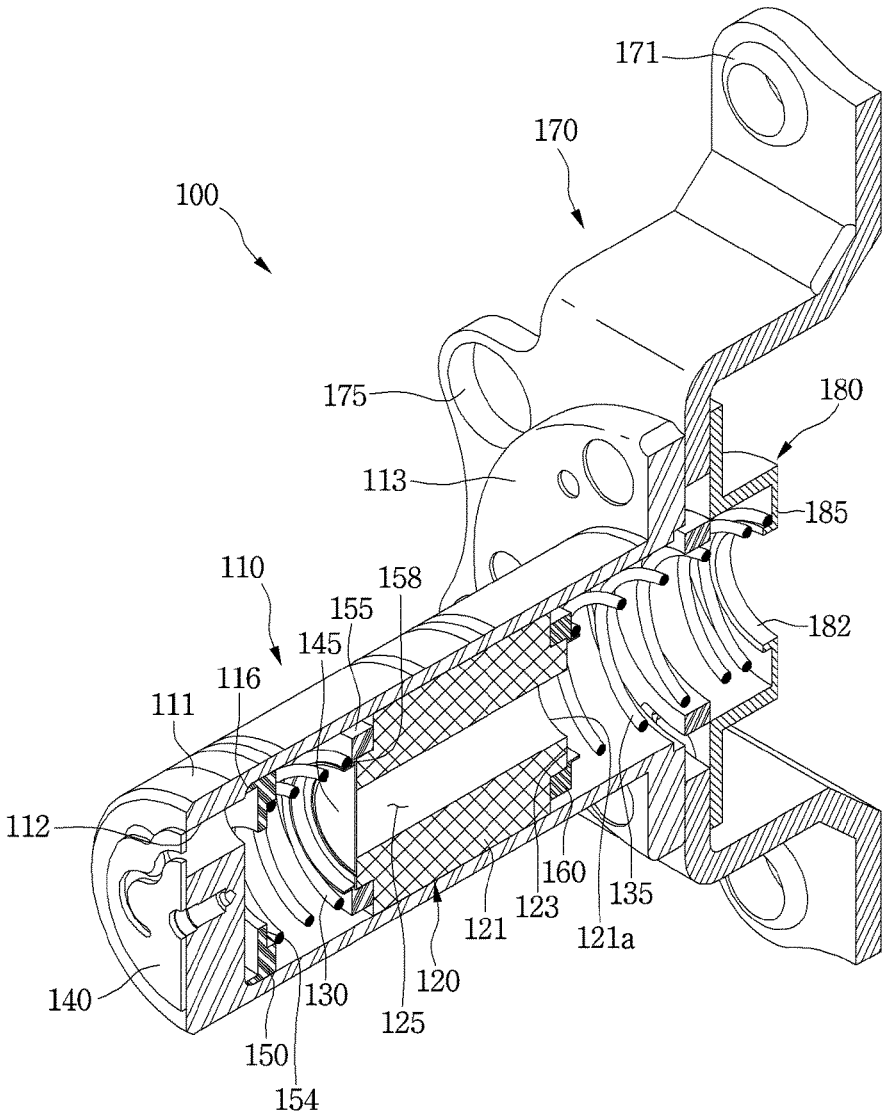
FIG. 2 is a cross-sectional perspective view illustrating a construction of a moving assembly provided in a linear compressor according to an embodiment.
Figure 3:
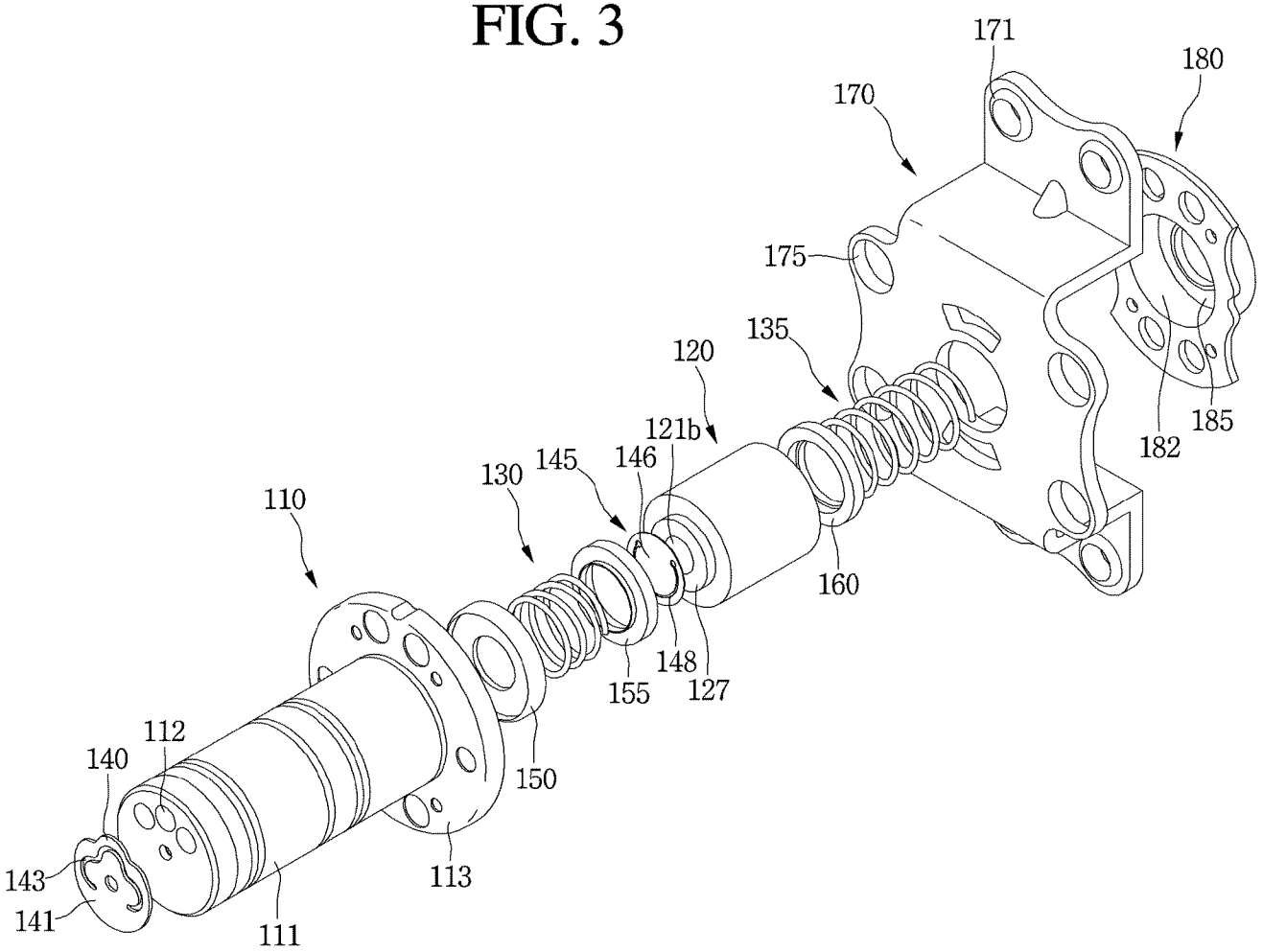
FIG. 3 is an exploded perspective view of the moving assembly according to an embodiment.
Figure 4:
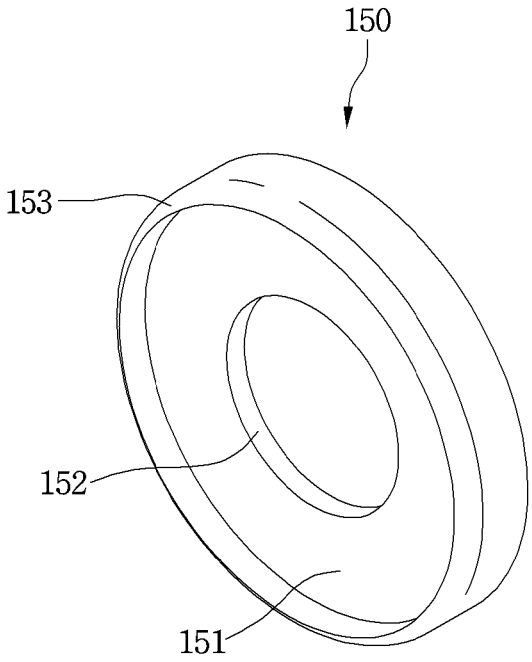
FIG. 4 is a perspective view illustrating a configuration of a first spring mounting unit or mount according to an embodiment.
Figure 5:
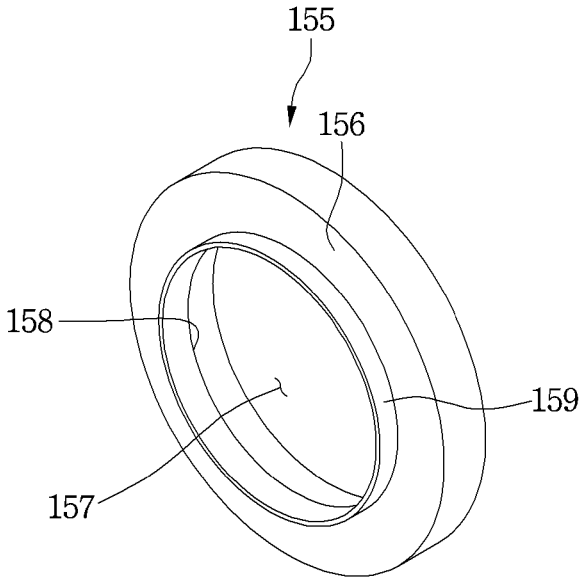
FIG. 5 is a perspective view illustrating a configuration of a second spring mounting unit or mount according to an embodiment.

FIG. 2 is a cross-sectional perspective view illustrating a construction of a moving assembly provided in a linear compressor according to an embodiment. FIG. 3 is an exploded perspective view of the moving assembly according to an embodiment FIG. 4 is a perspective view illustrating a configuration of a first spring mounting unit or mount according to an embodiment. FIG. 5 is a perspective view illustrating a configuration of a second spring mounting unit or mount according to an embodiment.

Referring to FIGS. 2 to 5, a moving assembly 100 provided to enable movement is included in a linear compressor according to an embodiment. The moving assembly 100 may be coupled a permanent magnet. For example, as described in the related art, the moving assembly 100 may be coupled to the permanent magnet by a connection member (not shown). The permanent magnet may reciprocate by a force generated by interaction between a flux generated by driving of a motor and a flux of the permanent magnet. Description of a construction and operation of the motor and the permanent magnet similar to or the same as that described with respect to the related art has been omitted.

The moving assembly 100 may include a first piston 110, in which a flow space of a refrigerant (hereinafter, a "first internal flow path") may be formed and which may be provided to enable a reciprocating movement, and a second piston 120, which may be installed in an interior of the first piston 110 and provided to enable a reciprocating movement. A space in which a refrigerant may be compressed by the second piston 120, that is, a second compression chamber 195 (refer to FIG. 6), may be formed in an inside of the first piston 110. The second compression chamber 195 may form a portion of the first internal flow path.

A suction hole 112 configured to discharge a refrigerant, which passes through the first internal flow path of the first piston 110, to a first compression chamber 190 (refer to FIG. 6) may be formed in the first piston 110. The suction hole 112 may be formed through at least a portion of the first piston 110. A plurality of the suction hole 112 may be provided.

The first piston 110 may include a first piston body 111 having an approximately cylindrical shape, and a piston flange 113 that extends radially from a rear end of the first piston body 111 and which may be connected to a permanent magnet. The suction hole 112 may be formed in a front portion of the first piston body 111. The front portion may include a surface that faces a discharge valve 210 (refer to FIG. 6).

A direction in which a refrigerant is introduced to the inside of the first piston 110 and flowing may be referred to as a "forward" direction and an opposite direction may be referred to as a "backward" direction. These definitions may be equally applied throughout the specification.

A first suction valve 140 coupled to the front portion of the first piston body 111 may be further included in the moving assembly 100. For example, a substantially central portion of the first suction valve 140 may be screw-fastened to a central front portion of the first piston body 111. The first suction valve 140 may be provided to move to selectively open the suction hole 112.

The first suction valve 140 may include a first opening and closing unit or device 141, which may be provided to cover the suction hole 112, and a first cut-out unit or cutout 143, which may be formed, for example, by cutting at least a portion of the first suction valve 140. The first cut-out unit 143 may be formed along an outer circumferential surface of the first opening and closing unit 141.

When a pressure of the first internal flow path is greater than a pressure of the first compression chamber 190, the first suction valve 140 may operate to open the suction hole 112. On the other hand, when the pressure of the first compression chamber 190 is greater than the pressure of the first internal flow path, the first suction valve 140 may operate to close the suction hole 112.

The second piston 120 may be installed in the first internal flow path of the first piston 110. A second piston body 121 forming a flow space 125 (hereinafter a "second internal flow path") of a refrigerant may be included in the second piston 120. The second internal flow path 125 may be formed on an inner side of the first internal flow path of the first piston 110, and form at least a portion of the first internal flow path.

An inlet 121*a*, which may be formed at one or a first side end and introduce a refrigerant to the second internal flow path 125, and an outlet 121*b*, which may be formed on the other or a second side end and discharge the refrigerant from the second internal flow path 125 may be included in the second piston body 121. The second internal flow path 125 may be configured to extend to the outlet 121*b* from the inlet 121*a*, and may be formed by passing through at least a portion of the second piston body 121.

A valve mounting unit or mount 127 that extends from the second piston body 121 and in which a second suction valve 145 may be placed may be further included in the second piston 120. For example, at least a portion of the second suction valve 145 may be fastened to the valve mounting unit 127. The outlet 121*b* may extend to the valve mounting unit 127. That is, the outlet 121*b* may be formed in the valve mounting unit 127.

The second suction valve 145 may include a second opening and closing unit or device 146 provided to cover the outlet 121*b*, and a second cut-out unit or cutout 148, which may be formed by cutting at least a portion of the second suction valve 145. The second cut-out unit 148 may be formed along an outer circumferential surface of the second opening and closing unit 146.

A supporter 170 coupled to one side of the first piston 110 may be further included in the moving assembly 100. For example, the supporter 170 may be fastened to a rear surface of the piston flange 113. The supporter 170 may move forward or backward together with the first piston 110.

Supports 171 and 175 that support a plurality of springs provided in the linear compressor may be included in the supporter 170. A first support 171 and a second support 175 may be included in the supports 171 and 175.

Figure 1:
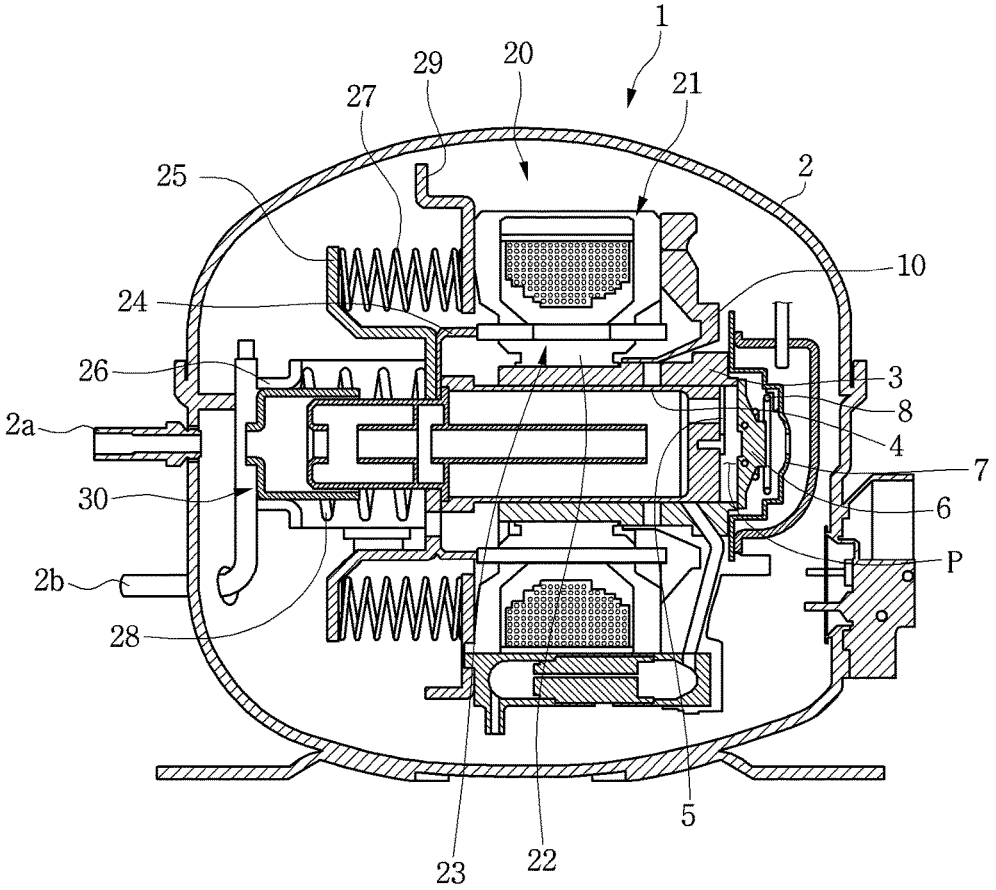
FIG. 1 RELATED ART
FIG. 1 is a cross-sectional view illustrating an internal structure of a related art linear compressor.

A first spring installed between the supporter 170 and a stator cover (refer to FIG. 1) may be coupled to the first support 171. A second spring supported between the supporter 170 and a back cover (refer to FIG. 1) may be coupled to the second support 175. For example, the first support 171 may be provided, respectively, on upper and lower portions of the supporter 170 and the second support 175 may be provided, respectively, on left or first side and right or second side portions of the supporter 170.

A cover 180 coupled to one side of the supporter 170 may be further included in the moving assembly 100. For example, the cover 180 may be coupled to a rear surface of the supporter 170.

The piston flange 113 may be coupled to a front surface of the supporter 170, and the cover 180 may be coupled to the rear surface of the supporter 170. At least a portion of the supporter 170 may be located between the piston flange 113 and the cover 180.

The cover 180 may include a hollow body, which may form a flow space of a refrigerant in the internal space. A communication unit or device 182 that guides the flow of a refrigerant may be included in the cover 180. The communication unit 182 may be connected to the first internal flow path of the first piston 110. Therefore, a refrigerant passing through the communication unit 182 may be introduced into the first internal flow path of the first piston 110. Then, a spring support 185 that supports a second spring 135 may be further included in the cover 180.

A first spring 130 provided in or at a refrigerant discharge side of the second piston 120 and the second spring 135 provided in or at a refrigerant suction side of the second piston 120 may be further included in the moving assembly 100. For example, the first spring 130 may be installed in front of the second piston 120, and the second spring 135 may be installed in rear of the second piston 120. In other words, the first spring 130 may extend toward the second piston 120 from a front portion of the first piston 110. The second spring 135 may extend toward the cover 180 from the second piston 120.

The first spring 130 and the second spring 135 may have a controlled inherent frequency so that the first and second pistons 110 and 120 may perform resonance motions in opposite directions, that is, may perform an anti-phase resonant motion. For example, a coil spring may be included in the first spring 130 or the second spring 135. The first spring 130 may be installed between an inner surface of the front portion of the first piston 110 and a front surface of the second piston 120.

A first spring mounting unit or mount 150 that supports one or a first side or end of the first spring 130 may be further included in the moving assembly 100. A first mounting body 151, and a piston support 153, which may protrude forward from the first mounting body 151 and be supported on an inner surface of the first piston 110 may be included in the first spring mounting unit 150.

A first penetration unit 152 or through-hole that guides a flow of a refrigerant may be formed in the first mounting body 151. For example, the first penetration unit 152 may be formed so as to penetrate forward and backward from a substantially central portion of the first mounting body 151.

The piston support 153 may be configured to protrude forward from an edge portion or edge of the first mounting body 151. A stepped unit or step 116 may be formed in an inner surface of the first piston 110. The stepped unit 116 may be formed on a rear surface of the front portion of the first piston 110, so that a front surface of the piston support 153 may be supported, and may be configured to extend in a radial direction from an inner circumferential surface of the first piston 110.

As the piston support 153 may be supported on the stepped unit 116, the first mounting body 151 may be spaced apart from the front portion of the first piston 110. Accordingly, the suction hole 112 may be prevented from being shielded by the first spring mounting unit 150.

A placed unit or step 154, in which the first spring 130 may be placed or located may be included in the first mounting body 151. The placed unit 154 may be configured so that at least a portion of a rear surface of the first mounting body 151 is recessed.

A second spring mounting unit or mount 155 that supports the other or a second side or end of the first spring 130 may be further included in the moving assembly 100. A second mounting body 156, and a spring support 159, which may protrude forward from the second mounting body 156 and support the first spring 130 may be included in the second spring mounting unit 155.

A second penetration unit or through-hole 157 that guides a flow of a refrigerant may be formed in the second mounting body 156. The second penetration unit 157 may be disposed or provided in front of the second suction valve 145, and a refrigerant discharged from the outlet 121*b* of the second piston 120 when the second suction valve 145 is opened may flow forward through the second penetration unit 157. For example, the second penetration unit 157 may be formed to penetrate forward and backward from a substantially central portion of the second mounting body 156.

The spring support 159 may have a substantially ring shape and may be configured to protrude forward from an edge portion or edge of the second mounting body 156. The other side portion of the first spring 130 may be disposed or provided on an outer circumferential surface of the spring support 159 and may be supported on one surface of the second mounting body 156. That is, the spring support 159 may be inserted into an inner side of the first spring 130 and may support the first spring 130. Therefore, during driving of the compressor, a stable supporting state about the second spring mounting unit 155 of the first spring 130 may be maintained.

A valve pressing unit or press 158 configured to press the second suction valve 145 to be mounted to the valve mounting unit 127 of the second piston 120 may be further included in the second spring mounting unit 155. The valve pressing unit 158 may be formed in a rear surface of the second mounting body 156, and be configured to extend in a radial direction and act to push a front surface of the second suction valve 145. That is, a rear surface of the second suction valve 145 may be placed or located on the valve mounting unit 127 of the second piston 120, and the front surface of the second suction valve 145 may be pressed by the valve pressing unit 158. By this configuration, the second suction valve 145 may be stably supported by the second piston 120 and the second spring mounting unit 155.

A third spring mounting unit or mount 160 that supports one or a first side or end of the second spring 135 may be further included in the moving assembly 100. A configuration of the third spring mounting unit 160 may be the same as a configuration of the second spring mounting unit 155, and thus, a detailed description thereof has been omitted. However, a direction in which the third spring mounting unit 160 is disposed or provided may be opposed to an arrangement direction of the second spring mounting unit 155. That is, a spring support provided on the third spring mounting unit 160 may be installed on a rear surface of the third spring mounting unit 160.

A protrusion 123 that protrudes backward from the second piston body 121 may be provided in a rear portion of the second piston 120. The inlet 121*a* may be formed on an inner side of the protrusion 123. The protrusion 123 may be coupled to an inner side of the third spring mounting unit 160. In other words, the third spring mounting unit 160 may be disposed or provided to surround an outer side of the protrusion 123.

The third spring mounting unit 160 may be coupled to the one side of the second spring 135. The one side of the second spring 135 may be disposed or provided on an outer circumferential surface of a spring support, which may be provided on the third spring mounting unit 160, and may be supported on a surface of a mounting body of the third spring mounting unit 160.

The spring support 185 that supports the other or a second side or end of the second spring 135 may be provided in the cover 180. The spring support 185 may be disposed or provided to surround the communication unit 182. In other words, a central portion of the spring support 185 may define the communication unit 182. According to mounting structures of the first and second springs 130 and 135, the second piston 120 may repeatedly perform a compression stroke forward and backward by the first and second springs 130 and 135.

Figure 6:
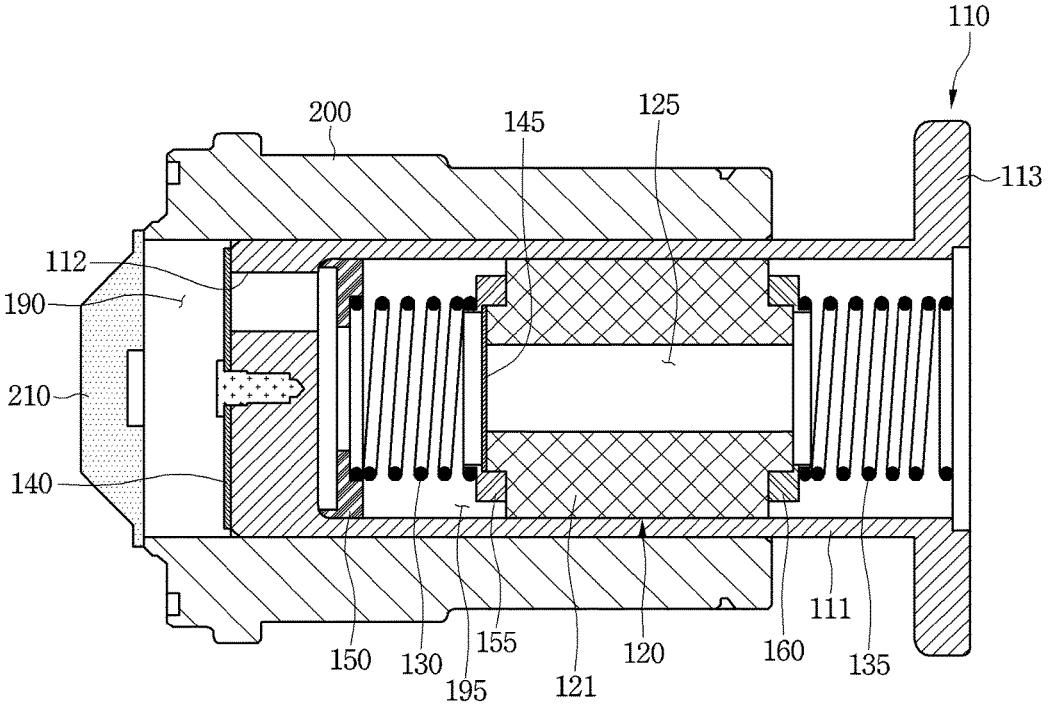
FIG. 6 is a cross-sectional view illustrating a state in which the moving assembly is coupled to a cylinder according to an embodiment.

FIG. 6 is a cross-sectional view illustrating a state in which the moving assembly is coupled to a cylinder according to an embodiment. Referring to FIG. 6, the first piston 110 may be movably inserted in an interior of a cylinder 200 according to an embodiment. The discharge valve 210, which may be selectively opened to discharge a refrigerant compressed in the interior of the cylinder 200 may be installed in front of the cylinder 200.

The first compression chamber 190 may be formed between the first piston 110 and the discharge valve 210. The first compression chamber 190 may form a part of an inner space of the cylinder 200, and a volume may be reduced or expanded according to a movement of the first piston 110.

For example, when the first piston 110 moves backward, the first compression chamber 190 may be expanded, and in this process, the first suction valve 140 may be opened and a refrigerant may be suctioned toward the first compression chamber 190. On the other hand, when the first piston 110 moves forward, the first compression chamber 190 may be reduced, and in this process, a refrigerant in the first compression chamber 190 may be compressed.

The first internal flow path in which a refrigerant may flow may be included in the first piston 110. The second piston 120 and the first and second springs 130 and 135 may be installed in the first internal flow path.

The second compression chamber 195 may be formed between the second piston 120 and the front portion of the first piston 110. The second compression chamber 195 may form a portion of the first internal flow path of the first piston 110 and a volume may be reduced or expanded according to a movement of the second piston 120.

For example, when the second piston 120 moves backward, the second compression chamber 195 may be expanded, and in the process, the second suction valve 145 may be opened and a refrigerant may be suctioned toward the second compression chamber 195. On the other hand, when the second piston 120 moves forward, the second compression chamber 195 may be reduced and in the process, a refrigerant in the second compression chamber 195 may be compressed.

Hereinafter, an anti-phase motion of the first and second pistons 110 and 120, and an action of the first and second suction valves 140 and 145 will be described.

Figure 12:
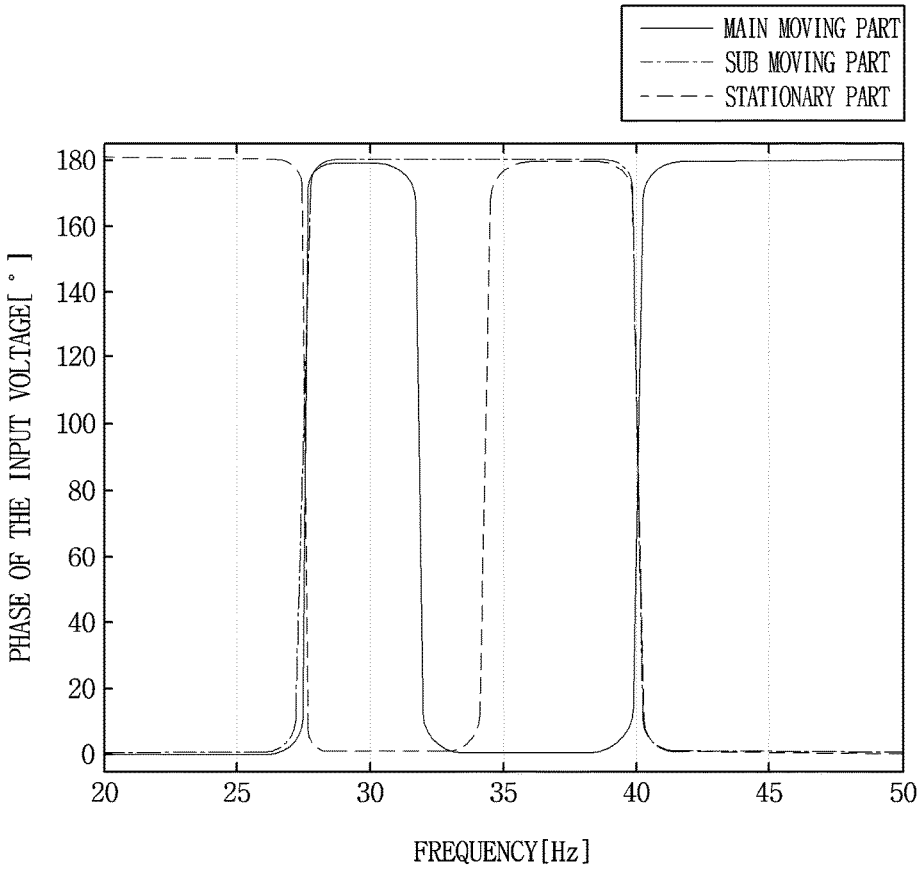
FIG. 12 is a graph illustrating a phase difference in input voltages of three components in accordance with a change of an input voltage frequency of the linear compressor according to an embodiment.
Figure 13:
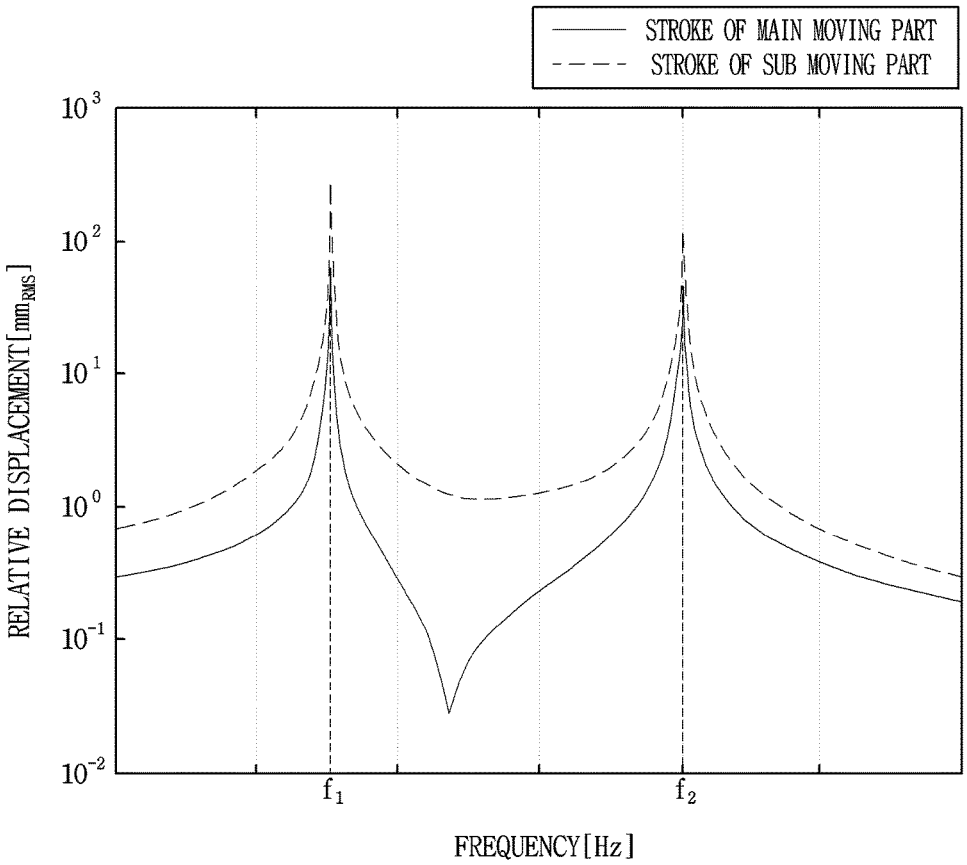
FIG. 13 is a graph showing a relationship between displacements of first and second pistons in accordance with the change of the input voltage frequency of the linear compressor according to an embodiment.

FIGS. 7 to 11 are schematic diagrams illustrating a state in which first and second pistons are performing an anti-phase behavior according to an embodiment. FIG. 12 is a graph illustrating a phase difference in input voltages of three components in accordance with a change of an input voltage frequency of the linear compressor according to an embodiment. FIG. 13 is a graph showing a relationship between displacements of first and second pistons in accordance with a change of an input voltage frequency of the linear compressor according to an embodiment.

In the driving process of the linear compressor, three parts or portions constituting or forming the linear compressor may behave according to an embodiment. A stationary part or portion, a main moving part or portion, and a sub moving part or portion may be included in the three parts.

For example, a motor that generates a driving force and the cylinder 200 that accommodates the first and second pistons 110 and 120 may be included in the stationary part. The first piston 110 and the permanent magnet 23 (refer to FIG. 1) may be included in the main moving part. The second piston 120 may be included in the sub moving part.

The motor may be supported by a spring, which may be installed in a lower portion of a shell of the linear compressor, and the cylinder 200 may be supported by a frame 10. Even though the motor and the cylinder do not make a substantially large motion, they may perform a movement in a predetermined direction as a reaction to movement of the moving assembly 100. By the reaction of the motor and the cylinder, vibration of the linear compressor may be reduced.

As described above, the first and second pistons 110 and 120 may perform a compression stroke of the refrigerant while moving forward or backward. On the other hand, the first and second pistons 110 and 120 may perform an anti-phase motion to each other (or opposite phase), that is, the movements may be in opposite directions to each other. The three parts that perform a motion, that is, the stationary part, the main moving part, and the sub moving part may have different masses. For example, the stationary part may have a largest mass, and the main moving part may have a mass greater than a mass of the sub moving part. The three parts may be operated by a voltage input to the motor of the linear compressor.

FIG. 12 illustrates a state about the three parts in which a phase difference with an input voltage is changed according to a frequency value of the input voltage. The input voltage may have a Sine waveform. When the phase difference about the input voltage of one part is zero, the one part is understood to make a motion in the Sine waveform. On the other hand, when the phase difference about the input voltage of one part is 180 degrees, the one part may have a negative Sine waveform.

For example, in a case in which a difference between a phase of any two parts and a phase of the input voltage is 0 or 180 degrees, the two parts are understood to make a motion in a same direction. On the other hand, when the difference between the phase of one part and the phase of the input voltage is zero and the difference between the phase of another part and the phase of the input voltage is 180 degrees, the one part and the other part may make a motion in opposite directions to each other (anti-phase behavior).

TABLE 1

| Frequency | 20.0~27.5 | 27.5~31.8 | 31.8~34.4 | 34.4~40.1 | 40.1~50.0 |
|---|---|---|---|---|---|
| Main moving part | In-phase | Anti-phase | Anti-phase | In-phase | Anti-phase |
| Sub moving part | In-phase | Anti-phase | Anti-phase | Anti-phase | In-phase |
| Stationary part | Anti-phase | In-phase | In-phase | Anti-phase | In-phase |

Table 1 shown above, as illustrated in the FIG. 12, shows a summary of the phase difference about the input voltage of the three parts according to the frequency rage. The term "In-phase" indicates having the same phase with the phase of the input voltage, that is, the phase difference is zero. The term "Anti-phase" indicates having the opposite phase with the phase of the input voltage, that is, the phase difference is 180 degrees.

In order to perform two-stage compression of a refrigerant passing through the linear compressor, a predetermined phase difference between the three parts needs to be set in advance according to an embodiment. For example, the stationary part (the cylinder) and the main moving part (the first piston) should do opposite phase behaviors to each other and the main moving part and the sub moving part (the second piston) should do opposite phase behaviors to each other to effectively make the two-stage compression of the refrigerant. In this case, the stationary part and the sub moving part would do the in-phase behavior.

Referring to FIG. 12 and Table 1, for the two-stage compression of the refrigerant, a frequency range of input voltage satisfying a phase difference condition of the three parts is shown to be about 34.4 Hz or higher.

FIG. 13 illustrates a relative displacement of a stroke of the first piston 110 or the second piston 120 in accordance with the frequency of the input voltage. A greater relative displacement may be understood to increase a refrigerating capacity of the linear compressor.

Referring to FIG. 13, the relative displacement of the stroke of the main moving part or the stroke of the sub moving part is shown to increase rapidly at a frequency of $f_1$ and a frequency of $f_2$. The frequency of $f_1$ and $f_2$ represents a resonant frequency of the linear compressor according to an embodiment. For example, the $f_1$ has a range of about 25 to 30 Hz and the $f_2$ has a range of about 37 to 42 Hz.

When the frequency of the input voltage and the resonant frequency match, a large refrigerating capacity may be made even with less power. However, the frequency of $f_1$ may be a frequency which does not correspond to an operating condition of the linear compressor according to an embodiment. That is, the frequency of the $f_1$ is relatively too low, and thus, provides limits to securing a required refrigerating capacity.

Therefore, adjusting the frequency of the input voltage to correspond to the $f_2$ provides an advantage of greatly securing the refrigerating capacity of the compressor according to an embodiment. In short, when setting the frequency of the input voltage to about 34.4 HZ or higher, a phase difference condition of the three parts is established and the two-stage compression may be performed, and more particularly, when setting in a range of about 37 to 42 Hz, it has an advantage of relatively greatly securing the refrigerating capacity of the compressor.

Figure 7:
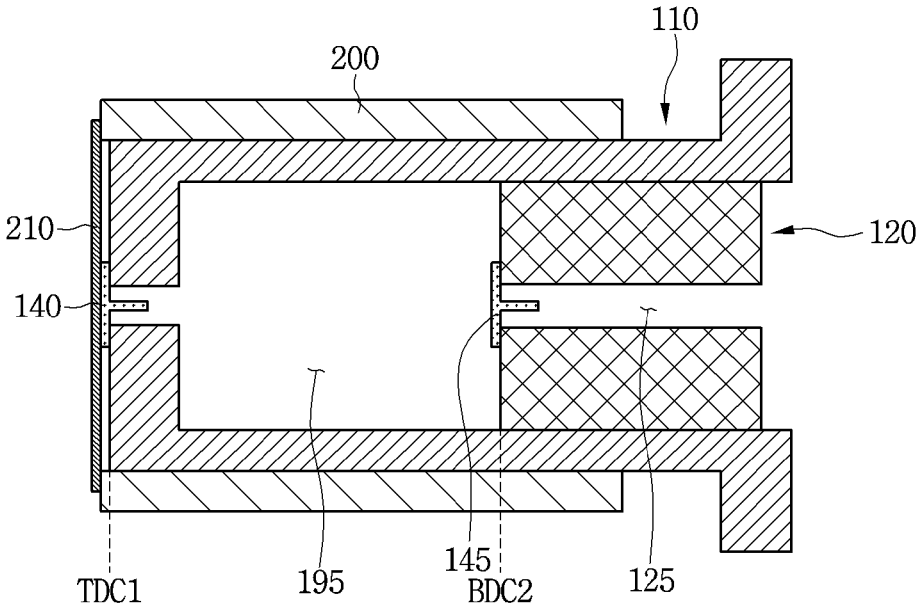
FIGS. 7 to 11 are schematic diagrams illustrating a state in which first and second pistons are performing an anti-phase behavior according to an embodiment.

FIG. 7 shows a state in which discharging of a refrigerant through the discharge valve 210 is completed after the refrigerant is compressed in the first compression chamber 190. At this time, the first piston 110 moves foremost and is located in or at a top dead center TDC1, the second piston 120 moves rearmost and is located in or at a bottom dead center BDC2. The first and second suction valves 140 and 145 and the discharge valve 210 are all in a closed condition.

A refrigerant is barely present in the first compression chamber 190, and a refrigerant inserted through the second internal flow path 125 of the second piston 120 is present in the second compression chamber 195. FIG. 7 is understood as a reference position of the moving assembly 100.

Figure 8:
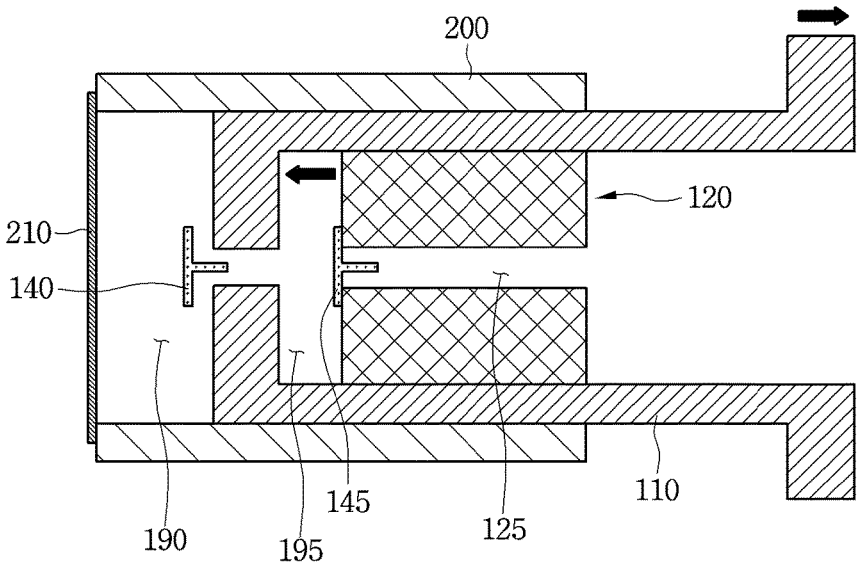

FIG. 8 shows a state in which the first piston 110 moves backward and the second piston 120 moves forward while in or from a state of FIG. 7. At this time, the refrigerant of the second compression chamber 195 is compressed in accordance with the forward movement of the second piston 120. Then, when the second piston 120 moves forward to a first predetermined position, a pressure of the second compression chamber 195 becomes greater than the pressure of the first compression chamber 190, and thus, the first suction valve 140 is opened.

According to the opening of the first suction valve 140, the refrigerant of the second compression chamber 195 may be introduced into the first compression chamber 190. Such backward movement of the first piston 110 and refrigerant suction toward the first compression chamber 190 may be made until reaching a rearmost position of the first piston 110, which is a bottom dead center BDC1. The second suction valve 145 maintains the closed state and the second piston 120 may move to a foremost position, which is a top dead center TDC2.

Figure 9:
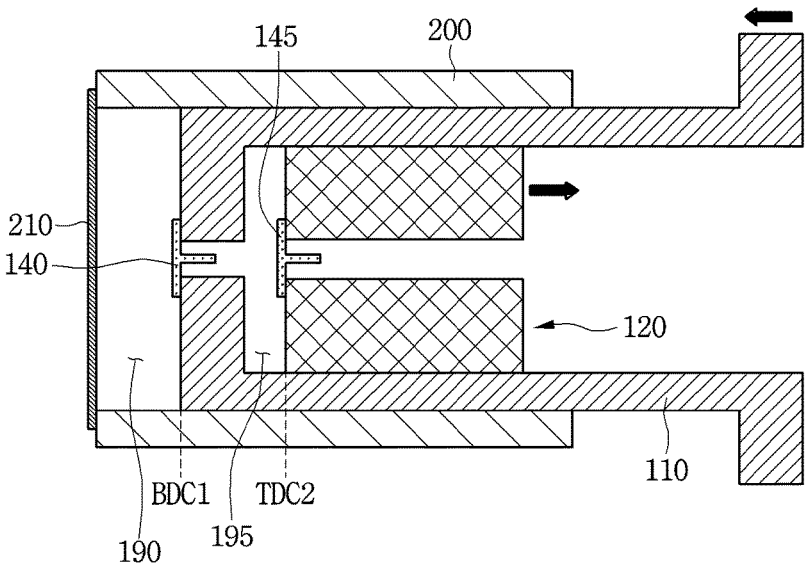

FIG. 9 shows a state in which the first suction valve 140 is closed after the refrigerant suction toward the first compression chamber 190 is completed and the first piston 110 moves forward while in a state of FIG. 8. In accordance with the forward movement of the first piston 110, a volume of the first compression chamber 190 become smaller and the refrigerant may be compressed.

The second piston 120 moves backward, and accordingly, a volume of the second compression chamber 195 becomes larger. As the volume of the second compression chamber 195 is increased, when the second piston 120 reaches a second predetermined position, the pressure of the second compression chamber 195 becomes smaller than the pressure of the second internal flow path 125 of the second piston 120.

Figure 10:
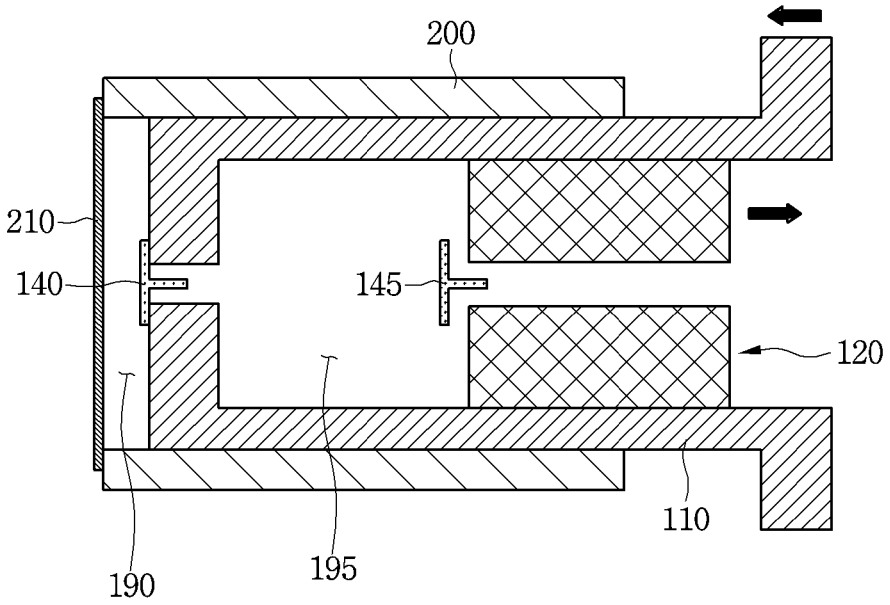
Figure 11:
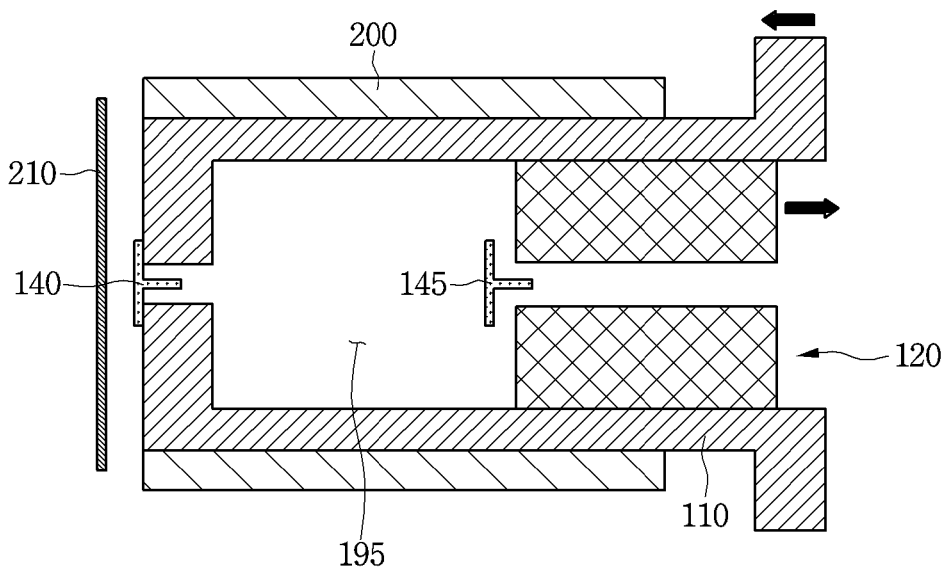

Therefore, as shown in the FIG. 10, the second suction valve 145 is opened and the refrigerant which flowed through the second internal flow path 125 may be suctioned to the second compression chamber 195 through the outlet 121*b*. This backward movement of the second piston 120 may be made until reaching to the rearmost position, that is, the bottom dead center BDC2.

In the state of FIG. 10, when the first piston 110 further moves forward and the pressure of the first compression chamber 190 becomes greater than an external pressure of the discharge valve 210, the discharge valve 210 is opened and the refrigerant of the first compression chamber 190 is discharged. When the refrigerant discharge from the compression chamber 190 is completed, positions of the first and second pistons 110 and 120 are in a state of FIG. 7. By this action, the refrigerant inserted to the internal flow path of the first piston 110 is primarily compressed in the second compression chamber 195 and secondarily compressed in the first compression chamber 190. Consequently, the two-stage compression of the refrigerant may be easily made.

Meanwhile, the volume of the second compression chamber 195 is formed larger than the volume of the first compression chamber 190. In other words, a stroke of the second piston 120 may be formed larger than a stroke of the first piston 110. By this configuration, after the primary compression in the second compression chamber 195, the secondary compression in the first compression chamber 190 may be made effectively.

Embodiments disclosed herein are directed to a linear compressor which is capable of improving a capacity of a compressor.

Embodiments disclosed herein provide a linear compressor that may include a cylinder to which a discharge valve may be coupled; a first piston, which may be provided to enable a reciprocating motion in an inside of the cylinder; a second piston, which may be provided to enable a reciprocating motion in an inside of the first piston; a first compression chamber formed between the discharge valve and the first piston; and a second compression chamber formed between the first piston and the second piston. The first piston and second piston may move in opposite directions to each other.

Embodiments disclosed herein further provide a linear compressor that may include a cylinder to which a discharge valve may be coupled; a first piston, which may be provided to enable a reciprocating motion in an inside of the cylinder; a second piston, which may be provided to enable a reciprocating motion in an inside of the first piston; a first compression chamber formed between the discharge valve and the first piston; and a second compression chamber formed in an inside of the first piston. A refrigerant of the second compression chamber may be suctioned to the first compression chamber when the first piston moves in one direction and the second piston moves in another direction. A refrigerant of the first compression chamber may be discharged outside and suction of the refrigerant may be performed to the second compression chamber when the first piston moves in the other direction and the second piston moves in the one direction, According to embodiments disclosed herein, as a plurality of compression chambers may be provided in an interior of a cylinder and a first piston and a second piston may be movably provided in each compression chamber, a stroke of a piston may be increased. As such, a capacity of a compressor may be improved without changing a size of a whole compressor.

Further, movements of the first and second pistons may be performed in mutually opposite directions, that is, by performing an anti-phase behavior, a refrigerant may be sequentially compressed in and discharged from the plurality of compression chambers. Furthermore, as three resonant frequencies may be defined by moving objects provided in the interior of the compressor, that is, a motor, a first piston, and a second piston, and a driving frequency of the compressor may be adjusted to correspond to a highest frequency of the three resonant frequencies, an anti-phase behavior of the first and second pistons may be effectively performed. In addition, as a size of a second compression chamber compressed by the second piston is formed larger than a size of a first compression chamber compressed by the first piston, a two-stage compression of a refrigerant may be facilitated.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a cylinder, to which a discharge valve is coupled;

a first piston, which is provided to enable a reciprocating motion of the first piston in an inside of the cylinder, the first piston including a front portion in which a suction hole is formed;

a first suction valve coupled to the front portion of the first piston and being configured to move to open or close the suction hole;

a floating second piston, which is provided to enable a reciprocating motion of the second piston in an inside of the first piston, the second piston including a through hole defining a flow path of a refrigerant;

a second suction valve coupled to the second piston and being configured to move to open or close the through hole;

a first compression chamber formed between the discharge valve and the first suction valve;

a second compression chamber formed between the front portion of the first piston and the second suction valve, wherein the first piston and the second piston move in opposite directions with respect to each other; and a first spring installed in the second compression chamber, the first spring being configured to be supported by the front portion of the first piston, wherein the second suction valve is disposed between the first spring and the second piston;

a second spring provided on a refrigerant suction side of the second piston, wherein the first spring is provided on a refrigerant discharge side of the second piston.

2. The linear compressor according to claim 1, wherein the first spring includes a coil spring.

3. The linear compressor according to claim 1, further including a first spring mount that supports a first side of the first spring and is installed on an inner surface of the first piston.

4. The linear compressor according to claim 3, further including a second spring mount that supports a second side of the first spring and is coupled to a first surface of the second piston.

5. The linear compressor according to claim 4, further including a third spring mount that supports a first side of the second spring and is coupled to a second surface of the second piston.

6. The linear compressor according to claim 1, further including:

a cover that supports the second spring and in which a communication device that introduces the refrigerant to the inside of the first piston is provided; and a supporter coupled to the cover and the first piston.

7. The linear compressor according to claim 6, wherein the first piston includes:

a piston body having a cylindrical shape and including the front portion in which the suction hole is formed; and a piston flange that extends radially from a rear end of the piston body.

8. The linear compressor according to claim 7, wherein the piston flange is coupled to a front surface of the supporter, and the cover is coupled to a rear surface of the supporter.

9. The linear compressor according to claim 8, wherein at least a portion of the supporter is located between the piston flange and the cover.

10. The linear compressor according to claim 3, wherein the first spring mount includes:

a first mounting body that guides a flow of the refrigerant; and a piston support that protrudes from an edge of the first mounting body and is supported by the inner surface of the first piston.

11. The linear compressor according to claim 10, further including a step that extends in a radial direction from an inner circumferential surface of the first piston and supports a surface of the piston support, wherein the first mounting body is spaced apart from the first piston by the step.

12. The linear compressor according to claim 4, wherein the second spring mount includes:

a second mounting body in which a through-hole that guides a flow of the refrigerant is formed; and a spring support that protrudes from the second mounting body and supports the first spring.

13. The linear compressor according to claim 12, wherein the second spring mount further includes a valve press that extends from a surface of the second mounting body in a radial direction and presses the second suction valve, so that the second suction valve is mounted on a valve mount of the second piston.

14. The linear compressor according to claim 1, further including a motor that generates a driving force, wherein a frequency of a voltage input to the motor is formed in a predetermined range, such that the cylinder and the first piston do an opposite phase behavior with respect to each other.

15. The linear compressor according to claim 14, wherein the frequency of the voltage input to the motor is within a predetermined range, such that the cylinder and the second piston do an in-phase behavior with respect to each other.

16. The linear compressor according to claim 1, wherein the second spring includes a coil spring.

17. A linear compressor, comprising:

a cylinder; and a plurality of pistons coaxially provided within the cylinder and forming a plurality of compression chambers within the cylinder, wherein the plurality of pistons is capable of moving in a same direction and opposite directions with respect to each other to perform in-phase and anti-phase behaviors with respect to one another while performing two stage compression of a refrigerant, wherein the plurality of pistons includes a first piston and a floating second piston, the second piston being provided within the first piston, wherein the plurality of compression chambers includes a first compression chamber provided between the first piston and a discharge valve provided at an end of the cylinder and a second compression chamber provided between the first piston and the second piston, wherein a refrigerant of the second compression chamber is suctioned into the first compression chamber when the first piston moves in a first direction and the second piston moves in a second direction, wherein the refrigerant of the first compression chamber is discharged and suction of the refrigerant into the second compression chamber is performed when the first piston moves in the second direction and the second piston moves in the first direction, wherein a first suction valve is coupled to a suction hole of the first piston and guides the refrigerant of the second compression chamber to the first compression chamber, wherein, a second suction valve is coupled to a through hole of the second piston and guides refrigerant in the through hole of the second piston to the second compression chamber, wherein a spring is installed in the second compression chamber, and wherein the second suction valve is disposed between the spring and the second piston.

18. The linear compressor according to claim 17, wherein the first direction is a backward direction to the second compression chamber from the first compression chamber, and the second direction is a forward direction to the first compression chamber from the second compression chamber.

* * * * *